United States Patent [19]

Austin

[11] 4,174,928

[45] Nov. 20, 1979

[54] DOUBLE ACTING CONCRETE PUMP

[76] Inventor: Richard D. Austin, 3337 Hopi Pl., San Diego, Calif. 92117

[21] Appl. No.: 885,588

[22] Filed: Mar. 13, 1978

[51] Int. Cl.[2] ..... F04B 17/00; F04B 15/02; F01L 23/00

[52] U.S. Cl. ..... 417/397; 91/341 R; 91/348; 417/900

[58] Field of Search ..... 417/397, 900; 91/327, 91/329, 341, 348

[56] References Cited

U.S. PATENT DOCUMENTS

| | | | |
|---|---|---|---|
| Re. 2,256 | 5/1866 | Thatcher | 417/397 |
| 1,729,430 | 9/1929 | Machtolf | 417/397 X |
| 2,169,703 | 8/1939 | Mason | 417/397 X |
| 2,187,972 | 1/1940 | Hollander | 417/900 X |
| 2,349,150 | 5/1944 | Falasconi | 417/397 X |
| 3,064,582 | 11/1962 | Knights | 91/329 X |
| 3,146,721 | 9/1964 | Scwing | 417/900 X |
| 3,279,383 | 10/1966 | Smith | 417/900 X |

*Primary Examiner*—Leonard E. Smith
*Attorney, Agent, or Firm*—Brown & Martin

[57] ABSTRACT

A double acting concrete pump having a pair of interconnected mud pistons driven by a reversing hydraulic actuator, which is reversed by the piston motion at the end of each stroke, and has a pressure relief to avoid bottoming at the end of a stroke. The mud pistons slide in cylinders which are lubricated and cleaned by a supply of lubricant circulated between the cylinders by the piston action. Concrete or similar mud-like material is drawn from a hopper and pumped out through a common outlet.

5 Claims, 5 Drawing Figures

DOUBLE ACTING CONCRETE PUMP

BACKGROUND OF THE INVENTION

In pumping concrete or similar high viscosity mud-like material, considerable power is required to maintain a reasonable flow rate. Various types of impellers, augers and the like have been used, but any mechanism which requires close tolerance fits between parts is at a disadvantage. Concrete and other mud material tends to clog any mechanism it comes in contact with and, if allowed to set, can render the mechanism inoperative. Most apparatus in present use requires constant maintenance and cleaning to keep it operable.

SUMMARY OF THE INVENTION

In the concrete pumping apparatus described herein the pumping mechanism is constantly lubricated and cleaned by the pumping action. A completely enclosed and protected double acting hydraulic piston actuator drives a pair of mud pistons in cylinders at opposite ends of the actuator. A jacket surrounding the actuator contains a lubricant which fills the mud cylinders behind the pistons and is pumped back and forth by the piston action, which provides constant lubrication and flushing of the cylinder walls.

Hydraulic power to the actuator is controlled by a reversing valve actuated by a limit switch mechanism, which is engaged by the mud pistons at the end of each stroke. The actuator piston is relieved to allow the hydraulic fluid pressure to begin the return stroke before the piston bottoms out.

A hopper is connected to both mud cylinders through combined inlet and outlet Tees, and the outlets are coupled to a common delivery outlet. The apparatus can be mounted on any suitable fixed or mobile support, with a power source for the hydraulic pressure.

The primary object of this invention, therefore, is to provide a new and improved double acting concrete pump.

Another object of this invention is to provide a double acting concrete pump in which the pump mechanism is self lubricating and cleaning.

A further object of this invention is to provide a double acting concrete pump which operates from a simple source of hydraulic pressure.

Other objects and advantages will be apparent in the following detailed description, taken in conjunction with the accompanying drawing, in which.

DESCRIPTION OF THE PREFERRED EMBODIMENT

Figure 1:
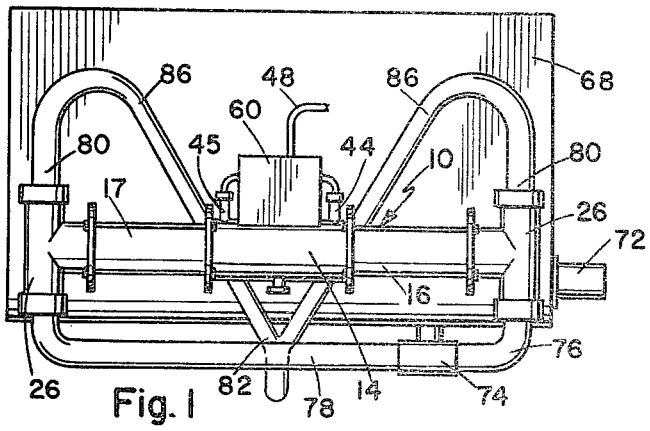
FIG. 1 is a front view of the apparatus.
Figure 2:
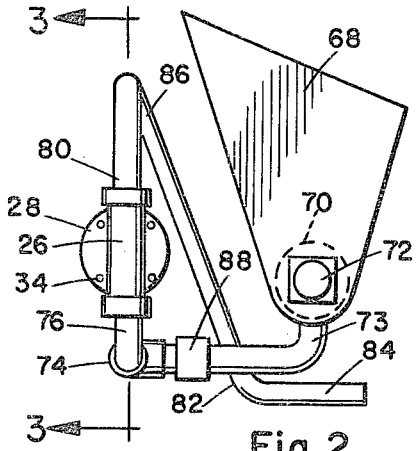
FIG. 2 is a side elevation view thereof.
Figure 3:
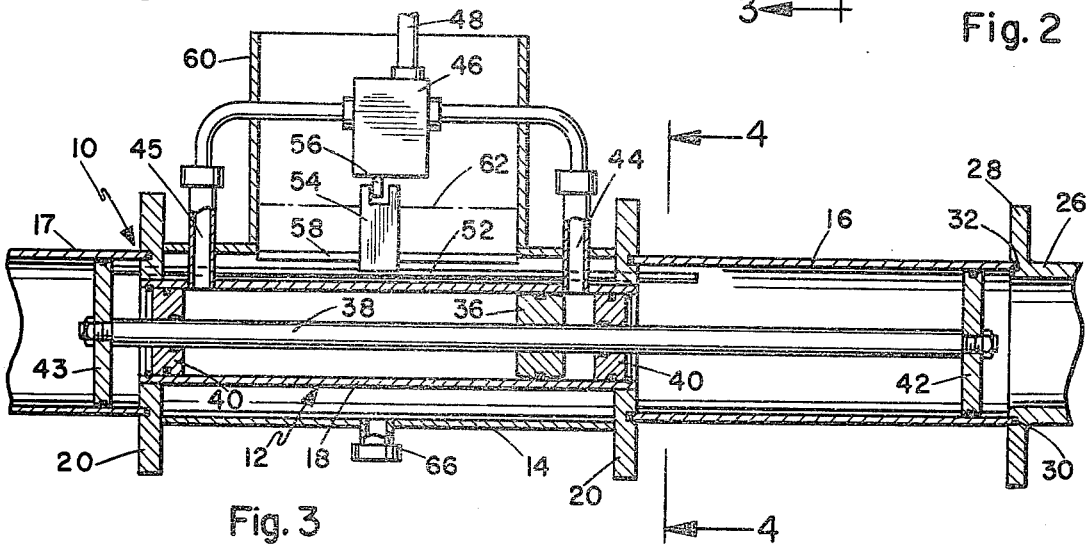
FIG. 3 is an enlarged sectional view taken on line 3—3 of FIG. 2.
Figure 5:
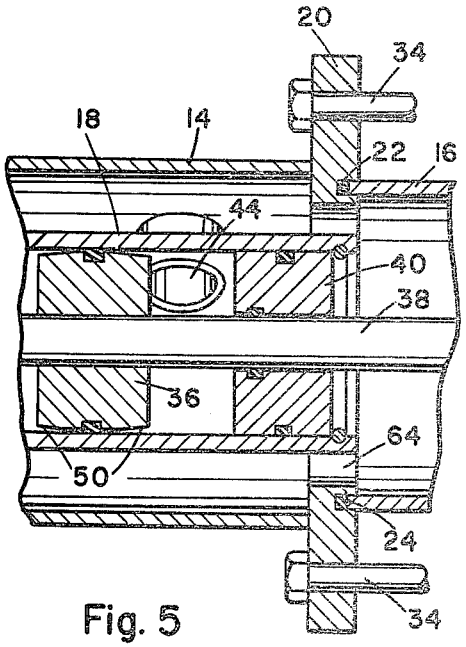
FIG. 5 is a sectional view taken on line 5—5 of FIG. 4.
Figure 4:
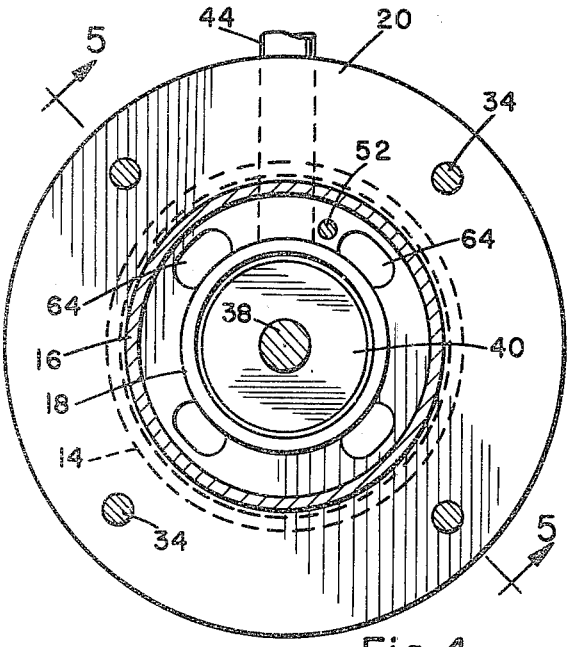
FIG. 4 is a further enlarged sectional view taken on line 4—4 of FIG. 3.

The pump unit 10 comprises a double acting hydraulic actuator 12 enclosed in a cylindrical jacket 14, with a pair of mud cylinders 16 and 17 extending axially from opposite ends. The actuator cylinder 18 has a large radial flange 20 fixed on each end, the jacket 14 being secured and sealed to the flanges, such as by welding. Mud cylinder 16 seats into a groove 22 in the outer face of flange and is sealed by an O-ring 24. On the outer end of mud cylinder 16 is a T-connector 26, having a flange 28 with a groove 30 into which the outer end of the mud cylinder seats, and is sealed by an O-ring 32. Bolts 34 extend between flanges 20 and 28 to clamp the T-connector 26 and mud cylinder 16 in place. The structure and assembly of mud cylinder 17 is identical to that of mud cylinder 16.

Actuator 12 has a piston 36 on a piston rod 38, which extends from both ends of the cylinder 18 through end plugs 40. On opposite ends of piston rod 38 are mud pistons 42 and 43, which slide in mud cylinders 16 and 17, respectively. At opposite ends of cylinder 18, adjacent the end plungs 40, are hydraulic inlets 44 and 45, which are connected through a reversing valve 46 to a pressure supply line 48. Any suitable hydraulic power source, not shown, may be used to operate the pump. Each end of piston 36 has a slight taper 50, so that at the end of a stroke, fluid can get behind the piston to start the return stroke. The reversing valve 46 is timed so that the hydraulic pressure is switching when the piston reaches the end of the stroke, and the arrangement prevents the piston from bottoming against the end plug.

The reversing valve 46 is actuated by an actuating rod 52 inside jacket 14, the rod extending slidably through flanges 20 into both mud cylinders 16 and 17. A yoke 54 fixed to rod 52 engages the reversing lever 56 of valve 46. The actuating rod 52 is engaged alternately by mud pistons 42 and 43 at the inner end of each stroke, to actuate valve 46 and reverse actuator 12.

In the upper portion of jacket 14 is an opening 58, over which is secured an upwardly extending reservoir box 60 enclosing valve 46. The reservoir contains a quantity of water soluble lubricant, indicated by level 62, which fills jacket 14 and the mud cylinders 16 and 17 behind the pistons. Flanges 20 have openings 64 between actuator cylinder 18 and jacket 14 to allow free flow of lubricant between the mud cylinders, pumped back and forth by the mud pistons. The lubricant thus lubricates and washes the interior of the mud cylinders continuously and lubricates actuating rod 52 for smooth operation. A drain plug 66 in jacket 14 facilitates changing the lubricant when necessary.

Concrete or other mud-like material is supplied from a hopper 68, containing a conventional screw auger 70 driven by a motor 72. An outlet pipe 73 leads from the hopper to a T-coupling 74, from which supply pipes 76 and 78 lead to the T-connectors 26. From the T-connectors 26, delivery pipes 80 extend to a Y-junction 82 and a common delivery outlet 84. The delivery pipes 80 have reduced diameter portions 86, which accelerates the flow and also tends to damp out the pulses of the reciprocating pump. A one way valve 88 can be installed in outlet pipe 73, or valves could be incorporated in the T-connectors 26 to control the flow direction. Each stroke of the actuator draws a charge of concrete into one mud cylinder, while at the same time the other mud cylinder is being discharged.

The entire assembly can be mounted on any suitable support structure, such as a wheeled trailer, which could carry the hydraulic power apparatus. A hose connected to delivery outlet 84 allow concrete to be pumped to any site not conveniently accessible to a concrete mix truck.

Having described my invention, I claim:

1. A double acting concrete pump, comprising:

an actuator having a reciprocating piston therein with a piston rod extending from opposite ends of the actuator;

a pair of mud cylinders mounted axially on opposite ends of said actuator, each having a mud piston therein secured to said piston rod;

said mud cylinders having outer ends with connector means thereon for connection to a source of fluid material to be pumped, and to a delivery outlet;

a lubricant containing reservoir including a jacket surrounding said actuator, with openings communicating with the inner ends of said mud cylinders by action of the mud pistons;

a source of power connected to said actuator;

and reversing means coupled to said source of power for reversing said reciprocating piston.

2. A double acting concrete pump according to claim 1, wherein said actuator is fluid pressure operated, said reversing means including a reversing valve mounted adjacent said actuator, an actuating rod axially slidably mounted on said actuator and extending into said mud cylinders for engagement by the mud pistons at the inner end of each stroke, and means coupling said actuating rod to said reversing valve;

said actuator having fluid inlets adjacent opposite ends thereof, and said actuator piston having tapered end portions for fluid ingress at the end of a stroke.

3. A double acting concrete pump according to claim 1, wherein said connector means includes T-connectors on the outer ends of said mud cylinders, with supply pipes for connection to a source of fluid material, and delivery pipes joined at a common delivery outlet.

4. A double acting concrete pump according to claim 3 and including one way valve means between said mud cylinders and the source of fluid material.

5. A double acting concrete pump according to claim 4, wherein said delivery pipes have reduced diameter portions.

* * * * *